United States Patent [19]

Westermann et al.

[11] 4,242,217

[45] Dec. 30, 1980

[54] COMPOSITION SUITABLE FOR USE IN CLEANING PANES OF GLASS

[75] Inventors: Lothar Westermann, Cologne; Horst-Dieter Wasel-Nielen, Hürth, both of Fed. Rep. of Germany

[73] Assignee: Hoechst Aktiengesellschaft, Fed. Rep. of Germany

[21] Appl. No.: 11,324

[22] Filed: Feb. 12, 1979

[30] Foreign Application Priority Data

Feb. 15, 1978 [DE] Fed. Rep. of Germany ..... 2806344

[51] Int. Cl.[3] ..... C11D 3/065; C11D 3/075

[52] U.S. Cl. ..... 252/135; 252/139; 252/532; 252/539; 252/540; 252/174.16

[58] Field of Search ..... 252/135, 139, 532, 539, 252/540, 174.16

[56] References Cited

U.S. PATENT DOCUMENTS

| | | | |
|---|---|---|---|
| 3,366,571 | 1/1968 | Cooper et al. | 252/99 |
| 3,523,902 | 8/1970 | Schmolka | 252/137 |
| 3,558,495 | 1/1971 | Mace | 252/90 |
| 3,595,968 | 7/1971 | Groves | 252/99 |
| 3,629,127 | 12/1971 | Palmer et al. | 252/55 |
| 4,048,121 | 9/1977 | Chang | 252/527 |
| 4,140,647 | 2/1979 | Mizutani et al. | 252/89 R |
| 4,152,306 | 5/1979 | De Matteo | 252/539 |

*Primary Examiner*—Earl A. Nielsen
*Attorney, Agent, or Firm*—Connolly and Hutz

[57] ABSTRACT

The invention provides a composition suitable for use in cleaning panes of glass consisting of a substantially homogeneous surfactant and binder containing blend, in the form of a hardened moulding, the blend containing:

(a) at least one water-soluble alkali metal phosphate;
(b) at least one anion-active and/or non-ionic surfactant;
(c) at least one alkali metal silicate, with or without water admixed therewith;
(d) at least one orthophosphoric acid mono- and/or dialkylester having 1 to 4 carbon atoms in its alkyl groups, or a specified type of product obtained by reacting phosphorus-V-oxide with a monohydric alcohol and an alkane polyol; with or without
(e) a complex former and/or a solvent.

7 Claims, No Drawings

COMPOSITION SUITABLE FOR USE IN CLEANING PANES OF GLASS

The present invention relates to a glass-pane cleaning composition consisting of a substantially homogeneous surfactant and binder containing blend, in the form of a hardened moulding.

It has already been proposed that phosphates and/or surfactants or solvents should be used as ingredients of liquid pasty of pulverulent cleaning compositions. If used in the form of an aqueous solution, they permit dirt or non-transparent streaks to be more of less completely removed from the windshield (windscreen) of a motor vehicle by means of a windshield washer mechanism.

Cleaning compositions which are based on surfactants and/or complex formers and are used in the form of highly viscous or pasty shampoos have also been described in the literature. These are normally applied mechanically to the windshield with the use of a suitable applicator, e.g. a sponge, and together with rain water of the water in the windshield washer.

In our experience, the cleaning compositions described heretofore are, however, not fully satisfactory, regardless of whether they are used in the form of an aqueous solution or shampoo. If applied in the form of an aqueous solution by means of a washer, the windshield is wetted therewith for only as long as the washer is actuated. As a result, the windshield is often insufficiently cleaned. If used in the form of a shampoo on a suitable applicator, the shampoo is liable to dissolve more or less rapidly, depending on the quantity of rain water falling on the applicator, so that the concentration of the cleaning composition in the wash water inevitably varies. As a result, the dirt on the windshield is incompletely removed in all cases in which the concentration of the cleaning composition in the wash water is too low, or the surfactant is liable to leave streaks on the windshield, which naturally adversely affect the necessary good vision in all cases in which the concentration of the cleaning composition in the wash water is too high.

It is therefore an object of the present invention to provide a solid and hard cleaning composition which in contact e.g. with rain water will reach the windshield in satisfactory and fairly constant concentration and will produce a good cleaning effect thereon.

According to the present invention, we provide a composition suitable for use in cleaning panes of glass, consisting of a substantially homogeneous surfactant and binder containing blend, in the form of a hardened moulding, the blend containing:

(a) at least one water-soluble alkali metal phosphate;
(b) at least one anion-active and/or non-ionic surfactant;
(c) an alkali metal silicate, with or without water admixed therewith;
(d) at least one orthophosphoric acid mono- and/or dialkyl ester having 1 to 4 carbon atoms in its alkyl groups, or a product obtained by reacting phosphorus-V-oxide with a monohydric alcohol and an alkane polyol containing 2 to 12 carbon atoms and 2 to 6 hydroxyl groups, in a molar ratio substantially equal to 1:2:4/n, or with a molar excess of the alcohols, n representing the number of hydroxyl groups in the molecule of the alkane polyol; with or without
(e) a complex former and/or a solvent.

The useful alkali metal phosphates comprise more particularly:

monosodium-dihydrogen-monophosphate,
disodium-hydrogen-monophosphate,
trisodium-monophosphate,
monopotassium-dihydrogen-monophosphate,
dipotassium-hydrogen-monophosphate,
tripotassium-monophosphate,
monoammonium-dihydrogen-monophosphate,
diammonium-hydrogen-monophosphate,
disodium-dihydrogen-diphosphate,
trisodium-hydrogen-diphosphate,
tetrasodium-diphosphate,
pentasodium-triphosphate, and
water-soluble polyphosphates of high molecular weight.

The cleaning composition of the present invention contains more preferably as phosphate components Graham's salt and tetrasodium diphosphate.

The useful anion-active surfactants comprise e.g. sodium alkylpolyglycolether sulfates having 10 to 18 carbon atoms in the alkyl group, secondary n-alkane sulfonates having 13 to 18 carbon atoms, and alkylbenzenesulfonates with an unbranched $C_{10}/C_{13}$ side chain.

The useful non-ionic surfactants comprise e.g. fatty alcohol polyglycolether oxethylates containing 12 to 18 carbon atoms and 3 to 25 mols of ethylene oxide, alkylarylpolyglycol ethers containing 1 to 10 carbon atoms in the alkyl radical and 4 to 30 mols of ethylene oxide, and alkyldimethylamine oxides containing 12 to 14 carbon atoms in the alkyl radical.

Very good cleaning effects are produced with compositions in which the surfactant is a sodium laurylpolyglycolether sulfate and/or a sodium salt of a secondary n-alkane sulfonate and/or an oxethylated tallow fatty alcohol containing 3 to 10 mols of ethylene oxide and/or a coco fatty acid dimethylamine oxide.

Preferably the cleaning composition contains sodium disilicate as its silicate component and the product which is obtained by reacting $P_4O_{10}$ with n-butanol and ethylene glycol in the molar ratio of 1:2:2 as its phosphoric acid ester component.

The phosphoric acid esters which are suitable for use in the cleaning compositions of the present invention can be prepared by the process described in German patent specification "Offenlegungsschrift" No. 2 645 211, wherein phosphorus-V-oxide is reacted with a mixture consisting of a monohydric alcohol and an alkane polyol containing 2 to 12 carbon atoms and 2 to 6 hydroxyl groups in a molar ratio of phosphours-V-oxide to alcohol to alkane polyol of 1:2:4/n, or with a molar excess of the alcohols, n representing the number of hydroxyl groups in the molecule of the alkane polyol.

A preferred embodiment of the process just described provides for the monohydric alcohol to comprise an aliphatic alcohol having 1 to 22 carbon atoms, or the product obtained by reacting an aliphatic alcohol having 1 to 22 carbon atoms or a phenol having 6 to 18 carbon atoms with 2 to 20 mols of ethylene oxide. Use can more preferably be made e.g. of methanol, ethanol, isopropanol, n-butanol, isobutanol, cyclohexanol, 2-ethylhexanol, lauryl alcohol, isotridecyl alcohol, stearyl alcohol, oleyl alcohol, a commercial mixture of aliphatic alcohols, 2-chlorethanol, 2,3-dibromopropanol-1, 3-methoxybutanol-1 or 2-phenylpropanol-1, or the ethylen oxide addition products of methyl glycol, ethyl glycol, butyl glycol or butyl diglycol, or the addition products of 4 mols of ethylene oxide and 1 mol of lauryl alcohol, of 8 mols of ethylene oxide and 1 mol of stearyl alcohol, of 6 mols of ethylene oxide and 1 mol of phenol or of 8 mols of ethylene oxide and 1 mol of nonyl phenol.

The alkane polyol components which are preferably employed comprise ethylene glycol, propanediol-1,2, propanediol-1,3, butanediol-1,3, butanediol-1,4, diethylene glycol, polyethylene glycol, neopentyl glycol, dibromoneopentyl glycol, glycerol, trimethylolpropane, mannitol of pentaerythritol.

Further substances which may optionally be added to the cleaning composition in the form of complex formers or solvents comprise compounds such as the sodium salt of ethylenediaminetetracetic acid of polyethylene glycol with a molecular weight of 200 to 1000.

In accordance with a preferred feature of the present invention, the composition is composed approximately of 30–80 weight% of a water-soluble alkali metal phosphate, 14–52 weight% of at least one anion-active and/or non-ionic surfactant, 2–9 weight% of the alkali metal silicate or a mixture of the alkali metal silicate with water in an approximate ratio by weight of 2:1 to 1:2, 2–6 weight% of the orthophosphoric acid mono- and/or dialkylester containing 1–4 carbon atoms in the alkyl group or the product obtained by reacting phosphorus-V-oxide with a monohydric alcohol and an alkane polyol containing 2–12 carbon atoms and 2–6 hydroxyl groups in the molar ratio of 1:2:4/n, of which a molar excess of the alcohols, n representing the number of hydroxyl groups in the molecule of the alkane polyol, and optionally up to 1 weight% of complex former, and up to 2 weight% of solvent.

The products of this invention can be made, for example, as follows: a solution comprising at least one anion-active and/or non-ionic surfactant, a complex former, a solvent, an alkalimetal silicate and an orthophosphoric acid ester is admixed with one or more alkali metal phosphates, preferably with one or more water-soluble polyphosphates of high molecular weight, the whole is kneaded with the aid of a kneader and homogenized, the resulting pasty mass being more or less readily formable, depending on the kneading period selected. The pasty mass assumes a hard solid consistency either after having been allowed to cool completely at room temperature, or after an ageing period of approximately 1 week depending on the mass's particular composition.

The expert would not have expected the cleaning composition of this invention to harden so favorably inasmuch as water-soluble polyphosphates of high molecular weight are known to be strongly hygroscopic compounds.

The cleaning composition of the present invention compares favorably with the prior art products in respect of the following: As a fully hardened mass, it dissolves very reluctantly in contact with water, such as rain water, snow, fog or the like so that the windshield of a moving vehicle becomes substantially regularly wetted therewith in approximately constant concentration under the action of the relative wind. As a result, oil and pigment dirt is very effectively removed, in the region of the wiping range of the windshield wipers, from the windshield which remains fully transparent and free from streaks and films of surfactant.

The composition of this invention can be placed in a device such as that described, for example, in "ADAC-Motorwelt", January 1978, page 25. The device which is a moulded article of plastics material is secured to the arm of the windshield wiper and comprises a tank receiving the cleaning composition and some sort of a comb fastened to the receiving side of the tank. Under rain, the relative wind causes the water to be forced through the spaces formed between the individual teeth of the comb and to be regularly distributed over the cleaning composition. As soon as a small quantity of cleaning composition has been dissolved in the rain water, the latter gets on to the windshield where the windshield wiper arms cause it to be distributed over the wiping range of the wipers.

The following Examples illustrate the invention which however is not limited thereto.

EXAMPLE 1

(Preparation of composition)

A blend was prepared from the following components:

(1) 9.7 parts by weight of a secondary n-alkane sulfonate containing 13 to 18 carbon atoms in the alkyl group, (2) 2.6 parts by weight of an adduct of alkyldiglycolether-sulfate sodium containing 12 to 14 carbon atoms in the alkyl chain and 3 mols of ethylene oxide, (3) 13.7 parts by weight of an adduct of the sodium salt of lauryldiglycolethersulfate with 2 mols of ethylen oxide, (4) 0.4 part by weight of an adduct of tallow fatty alcohol with 5 mols of ethylene oxide, (5) 0.6 part by weight of coco fatty acid dimethylamine oxide, (6) 0.3 part by weight of the sodium salt of ethylene diamine tetracetic acid, (7) 0.6 part by weight of polyethyleneglycol with a molecular weight of 200, (8) 2.9 parts by weight of the reaction product of $P_4O_{10}$ with n-butanol and ethylene glycol in the molar ratio of 1:2:2, prepared as described in Example 1 of German Patent Specification "Offenlegungsschrift" 2 645 211, (9) 4.5 parts by weight of sodium disilicate,

(10) 2.0 parts by weight of tetrasodium diphosphate, and

(11) 62.7 parts by weight of a high molecular water-soluble polyphosphate containing approximately 68% of $P_2O_5$.

More specifically, the components (1) through (9) were heated and stirred to give a homogeneous solution. Next, the solution was placed in a kneader, admixed with a coarse premixture of components (10) and (11), and the whole was homogenized at a temperature which was not permitted to exceed 49° C. so as to obtain a mass of satisfactory processability and formability. The mixing time depended on the particular kneader employed. The formable pasty mass so made hardened at room temperature within a period of 6 to 7 days. By allowing the mass to age over a period of approximately 30 minutes to 3 hours at 50° to 80° C., it was possible to accelerate the hardening process.

EXAMPLE 2

(Corrosion test)

Three specimens of the cleaning composition of Example 1 were wetted or diluted with water in the following quantitative ratios:

(a) 1 part by weight of cleaning composition and 5 parts by weight of water;

(b) 1 part by weight of cleaning composition and 10 parts by weight of water; and (c) 1 part by weight of cleaning composition and 20 parts by weight of water.

The resulting three aqueous solutions (a), (b) and (c) were applied to the surface of differently lacquered automobile metal sheets. The lacquered surfaces could not be found to have been impaired in contact with the solution after 48 hours. In another test series, the three solutions were brought into contact over a period of 48 hours with rubber packings and aluminium ornamental ledges of passenger vehicles. The two materials could not be found to have been corroded after that time.

EXAMPLE 3

(Cleaning test)

Specimens of the cleaning composition of Example 1 were diluted with water in the ratio of 1:1000–2000 and the resulting aqueous solutions were tested as to their cleaning power on the windshields of motor vehicles. The windshield surfaces had been soiled with a mixture of pigment dirt, rubber fines and oil and gasoline-containing dirt. The solutions were sprayed onto the windshields, distributed thereon by means of the windshield wipers. Visual inspection of the windshields so cleaned with aqueous solutions containing the cleaning composition in a concentration of 0.05 to 0.1 weight% indicated that the windshields had been completely cleaned in the region of the windshield wipers, were free from streaks and of optimum transparency.

EXAMPLE 4

(Cleaning test)

7 g of the cleaning composition of Example 1 was placed in the device described in "ADAC-Motorwelt", January 1978, page 25. After the cleaning composition was completely hard, the device was secured to the moving portion of a wiper arm and water was allowed to drop thereinto, simulating normal rainfall. After 7 hours, the cleaning composition was found to have been completely washed out from the container, with the use of approximately 140 ml of water. This corresponded to a 5 weight% concentration of the cleaning composition which the relative wind forced into contact with the windshield wetted with rain water, on which it was further diluted depending on the rainfall and travelling speed of the vehicle.

The above data determined in the laboratory were confirmed in practice during prolonged tours of vehicles under different rainfalls. 7 g of the cleaning composition of Example 1 were needed over a travelling distance of 700 km at an average travelling speed of 100 km/h.

We claim:

1. Composition suitable for use in cleaning panes of glass, consisting of a substantially homogeneous surfactant and binder containing blend, in the form of a hardened moulding, the blend containing:

(a) at least one water-soluble alkali metal phosphate;

(b) at least one anion-active surfactant or non-ionic surfactant or both;

(c) an alkali metal silicate, with or without water admixed therewith;

(d) a product obtained by reacting $P_4O_{10}$ with n-butanol and ethylene glycol in a molar ratio equal to about 1:2:2;

(e) the composition being with or without a complex former or a solvent or both.

2. The composition as claimed in claim 1, containing about:

30–80 weight% of a water-soluble alkali metal phosphate;

14–52 weight% of at least one anion-active and/or non-ionic surfactant;

2–9 weight% of alkali metal silicate with or without water admixed therewith, the ratio of alkali metal silicate to water in the latter case being 2:1 to 1:2 respectively;

2–6 weight% of constituent "d" as specified in claim 1; with or without up to 1 weight% of complex former, and up to 2 weight% of solvent.

3. The composition as claimed in claim 1, wherein the at least one water-soluble alkali metal phosphate comprises Graham's salt and tetrasodium diphosphate.

4. The composition as claimed in claim 1, wherein the at least one surfactant comprises sodium laurylpolyglycolethersulfate, a sodium salt of a secondary n-alkane sulfonate, an oxethylated tallow fatty alcohol containing 3 to 10 mols of ethylene oxide, a coco fatty acid dimethylamine oxide, or a mixture of two or more thereof.

5. The composition as claimed in claim 1, wherein the alkali metal silicate is sodium disilicate.

6. The composition as claimed in claim 1, containing a complex former, this being the sodium salt of ethylenediamine-tetracetic acid.

7. The composition as claimed in claim 1, containing a solvent, this being polyethylene glycol with a molecular weight of 200 to 1000.

* * * * *